US006679481B2

(12) United States Patent
McNalley et al.

(10) Patent No.: US 6,679,481 B2
(45) Date of Patent: Jan. 20, 2004

(54) FENCING SYSTEM HAVING INTERLOCKING TUBULAR POSTS AND CROSS MEMBERS

(76) Inventors: Albey Clarence McNalley, R.R. #1, Cadogan, Alberta (CA), T0B 0T0; Timothy Clifford McNalley, Box 612, Provost, Alberta (CA), T0B 3S0

( * ) Notice: Subject to any disclaimer, the term of this patent is extended or adjusted under 35 U.S.C. 154(b) by 0 days.

(21) Appl. No.: 10/167,943

(22) Filed: Jun. 13, 2002

(65) Prior Publication Data

US 2003/0230745 A1 Dec. 18, 2003

(51) Int. Cl.[7] ..... E04H 17/14
(52) U.S. Cl. ..... 256/65.12; 256/65.01
(58) Field of Search ..... 256/19, 59, 62, 256/65.01, 65.02, 65.12, 65.13, 67, 65.03, 65.04, 65.05, 65.08, 65.11; 403/389, 396, 403

(56) References Cited

U.S. PATENT DOCUMENTS

| | | | | |
|---|---|---|---|---|
| 2,242,427 A | | 5/1941 | Heanue | |
| 3,462,126 A | | 8/1969 | Demanega | |
| 3,787,033 A | | 1/1974 | Snyder et al. | |
| 3,921,960 A | | 11/1975 | Bright | |
| 4,072,294 A | | 2/1978 | Densen | |
| 4,149,701 A | | 4/1979 | Densen | |
| 4,477,059 A | | 10/1984 | Willis | |
| 4,682,761 A | | 7/1987 | Hanneken | |
| 4,691,897 A | | 9/1987 | Frush | |
| 5,354,037 A | | 10/1994 | Venegas, Jr. | |
| 5,647,681 A | * | 7/1997 | Chen | 256/59 X |
| 5,857,664 A | | 1/1999 | Schauman | |
| 6,142,453 A | | 11/2000 | Martin | |
| 6,260,828 B1 | | 7/2001 | English | |
| 6,279,879 B1 | | 8/2001 | Statz | |

* cited by examiner

*Primary Examiner*—Lynne H. Browne
*Assistant Examiner*—Ryan M. Flandro
(74) *Attorney, Agent, or Firm*—Antony C. Edwards

(57) ABSTRACT

The fencing system of the present invention includes elongate posts and cross-members. The posts are hollow tubular posts having cylindrical cavities along their length and apertures formed in side walls thereof. The apertures are for accepting in mating engagement therein the cross-members when the cross-members extend between adjacent posts in a parallel array of the posts. The cross-members each have a hole in at least one end thereof although usually in both ends, the holes extending laterally through the end or ends of the cross-members. A rod is inserted or insertable into the cylindrical cavity of at least one of the posts for mating into each hole of each of the cross-members when the cross-members are mated into the apertures. Each hole of each of the cross-members is sized to accept the rod in journalled relation therethrough. Thus, a single rod may releasably lock a plurality of cross-members mounted to a single post.

20 Claims, 6 Drawing Sheets

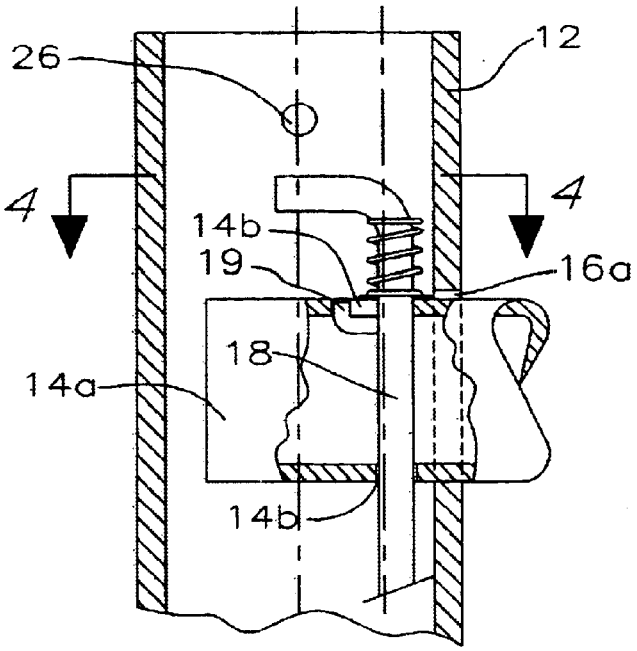
Fig 3
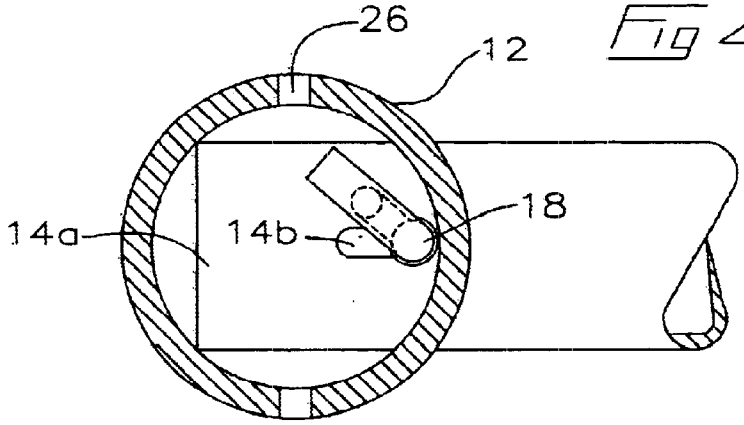
Fig 4
Fig 5
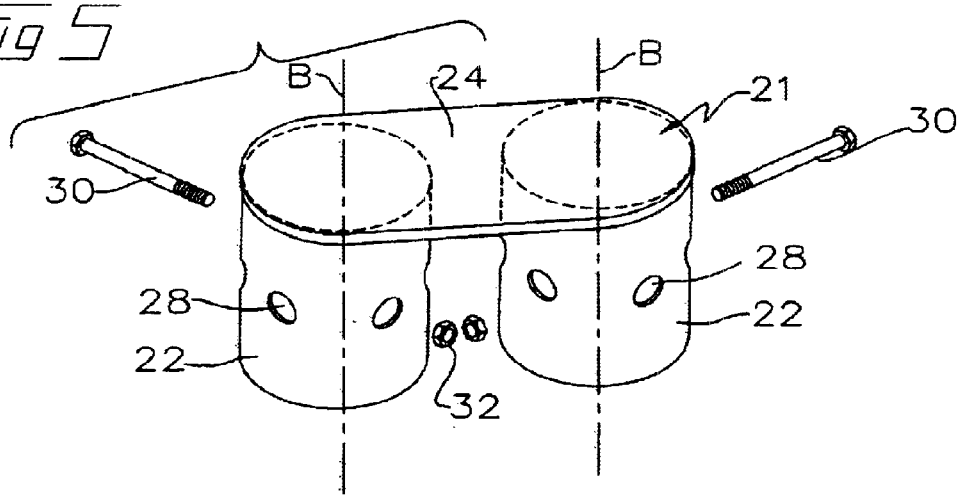

16
12
14
14b
14a
16a
18
30
21
32
26
B
24
22
28
12a
A

FENCING SYSTEM HAVING INTERLOCKING TUBULAR POSTS AND CROSS MEMBERS

FIELD OF THE INVENTION

This invention relates to the field of fencing, and in particular to fencing where the fence posts are tubes and where the cross-members may also be tubes.

BACKGROUND OF THE INVENTION

The prior art is replete with improvements in the art of fencing, and in particular in improvements of the various elements which make up a fence. The problems which are, of course, faced normally by a fencing practitioner require that fencing components be inexpensively obtained, inexpensively transported, efficiently installed, and durable and stable over extended periods of time when exposed to all environmental conditions. With respect to fence posts in particular, it is desirable that the posts themselves be relatively lightweight for transportation, and be relatively easily insertable into the ground, for example by having a pointed lower end, so that the requisite post hole digging is kept to a minimum, while maximizing the stability of the post. Often, where the posts are made of wood, the wood has to be treated to delay the onset of moisture induced rot.

Prior art is also replete with attempts to ease the mounting or hanging of cross-members which extend between fence posts.

The most relevant piece of prior art of which applicant is aware is U.S. Pat. No. 3,921,960 which issued to Bright on Nov. 25, 1975 for his rail and post fencing. Bright discloses the use of pre-formed fencing sections that may be positioned in end-to-end relation, each section being secured to an adjacent section to construct the fence. Each fence section includes a pair of end posts, intermediate posts between the end posts, and a plurality of fence rails. The posts and the rails are all tubular. The tubular rails extend through corresponding apertures in the intermediate posts, the ends of the rails inserting into blind apertures in each end post. Each end of each rail is formed with apertures for receiving an elongated locking rod so that, with the ends of the rails inserted into the blind apertures in the end posts, and with the apertures in the ends of the rails coaxially aligned, the locking rod may be inserted through the apertures in the ends of the rails to lock the rails to the end posts. With the ends of the rails inserted through the blind apertures in the end posts, the apertures in the ends of the rails are aligned coaxially with the longitudinal axis of symmetry of the end post.

Bright teaches that without anything more than the locking rod and the rail apertures, the assembly of the end post locking structure is extremely difficult because it is not possible to closely control the alignment or position of the innermost end of the locking rod as it is inserted into the end post. In particular, Bright advises that the longer the end post, the more difficult is the assembly. Consequently, Bright provides a plurality of locking rod spacers which are wedged or frictionally secured to and within the end posts, the spacers each preferably taking the form of a flat body having a substantially centrally positioned aperture formed therein. Bright teaches that it is preferred to employ one spacer for each rail end positioned adjacent each railed receiving end post aperture. The locking rod is inserted from the top of the end post, through the rail apertures and also through the apertures in the spacers, a major function of the spacers being to align and position the rod centrally and axially of the end posts during insertion of the locking rod. Bright teaches that the use of the spacers substantially eliminates the problem of "finding" the several rail apertures as the distance between the rail apertures and the upper end of the end post increases.

SUMMARY OF THE INVENTION

In summary, the fencing system of the present invention includes elongate posts and cross-members. The posts are hollow tubular posts having cylindrical cavities along their length and apertures formed in side walls thereof. The apertures are for accepting in mating engagement therein the cross-members when the cross-members extend between adjacent posts in a parallel array of the posts. The cross-members each have a hole in at least one end thereof although usually in both ends, the hole holes extending laterally through the end or ends of the cross-members. A rod is inserted or insertable into the cylindrical cavity of at least one of the posts for mating into each hole of each of the cross-members when the cross-members are mated into the apertures. Each hole of each of the cross-members is sized to accept the rod in journalled relation therethrough. Thus, a single rod may releasably lock a plurality of cross-members mounted to a single post. Each hole in the cross members is spaced inwardly from the ends of the cross member so as to be positioned adjacent to the inner radial surface of the post, when the cross member is fully inserted within the post. The locking rod may then be guided by the inner surface of the post to engage each hole in the cross member of a fence panel.

The fence posts may include posts, characterized for ease of reference as first posts, having a fist spaced apart array of a . The apertures are spaced apart along a length of the fist posts. The first array of ale s are longitudinally spaced from one another relative to respective longitudinal axes of the first posts. Each longitudinal axis may be an axis of symmetry of the first posts. The first posts may be corner or end posts.

The first posts may also be intermediate posts where a first and second spaced apart array of apertures are diametrically aligned so that a single parallel co-planar set of the cross-members may be journalled through both the first and second arrays of apertures in each of the intermediate posts.

The posts may also be used in an embodiment where at least one pair of the posts are coupled in adjacent parallel relation to one another by at least one coupler. The coupler may include a pair of post-engaging members mounted to a common rigid member, the post-engaging members adapted to mate with adjacent first ends of the pair of posts. In one embodiment not intended to be limiting the post-engaging members may be collars, sized to snugly journal into or over the first ends of the pair of posts. Where it is desirable to provide cross or "T" fencing, a coupler having three post-engaging members coupled in adjacent parallel relation to one another may be employed. End posts of a parallel run of fence panels are engaged within the outside pair of post-engaging members and an end post of a cross or "T" fence panel is retained within the center post-engaging member.

In a preferred embodiment, again not intended to be limiting, each first end of the first ends of the pair of posts has a hole in a side wall thereof and the collars each have a radially spaced-apart array of holes radially spaced around axes of symmetry of the collars. Thus, when the collars are mounted to the first ends of the pair of posts so that the axes of symmetry of the collars are co-axial with axes of symmetry of the posts, the hole in each first end may be selectively aligned with a hole in each radially spaced-apart array of holes around each collar. A locking member may then be fastened through the aligned holes to releasably lock the pair of posts in desired positions relative to one another so as to releasably lock a first array of apertures in a first adjacent post of the pair of posts in desired angular relation relative to a second array of apertures on a second adjacent post of the pair of posts.

The coupler may advantageously be a pair of couplers mountable to opposite ends of the pair of posts so as to maintain the pair of posts in their parallel adjacent relation

BRIEF DESCRIPTION OF THE DRAWINGS

FIG. 3 is, in partial cross-section, an enlarged sectional view, illustrating the mounting of cross-members to a post according to one embodiment of the present invention.

FIG. 5 is, in perspective view, the post coupler of the present invention.

FIG. 9 is an exploded perspective view of the components of the present invention.

FIG. 9*a* is a perspective view of an alternative form of coupler illustrated in FIG. 9.

DETAILED DESCRIPTION OF EMBODIMENTS OF THE INVENTION

The fencing system of the present invention takes advantage of the availability, commercially, of lengths of relatively rigid tubing such as, for example, fibreglass piping presently available in, for example, thirty foot lengths. Such tubing or piping is commercially available in various diameters, for example fibreglass piping is presently available in 2 inch, 3 inch, 4 inch and 6 inch diameters having various wall widths, for example that vary from 3⁄16 of an inch to 3⁄8 of an inch.

Figure 1:
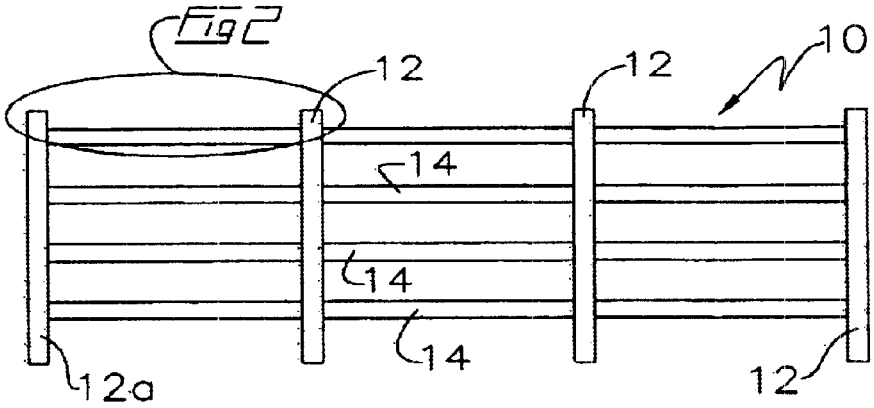
FIG. 1 is, in front elevation view, a fence panel constructed according to one embodiment of the present invention.
Figure 2:
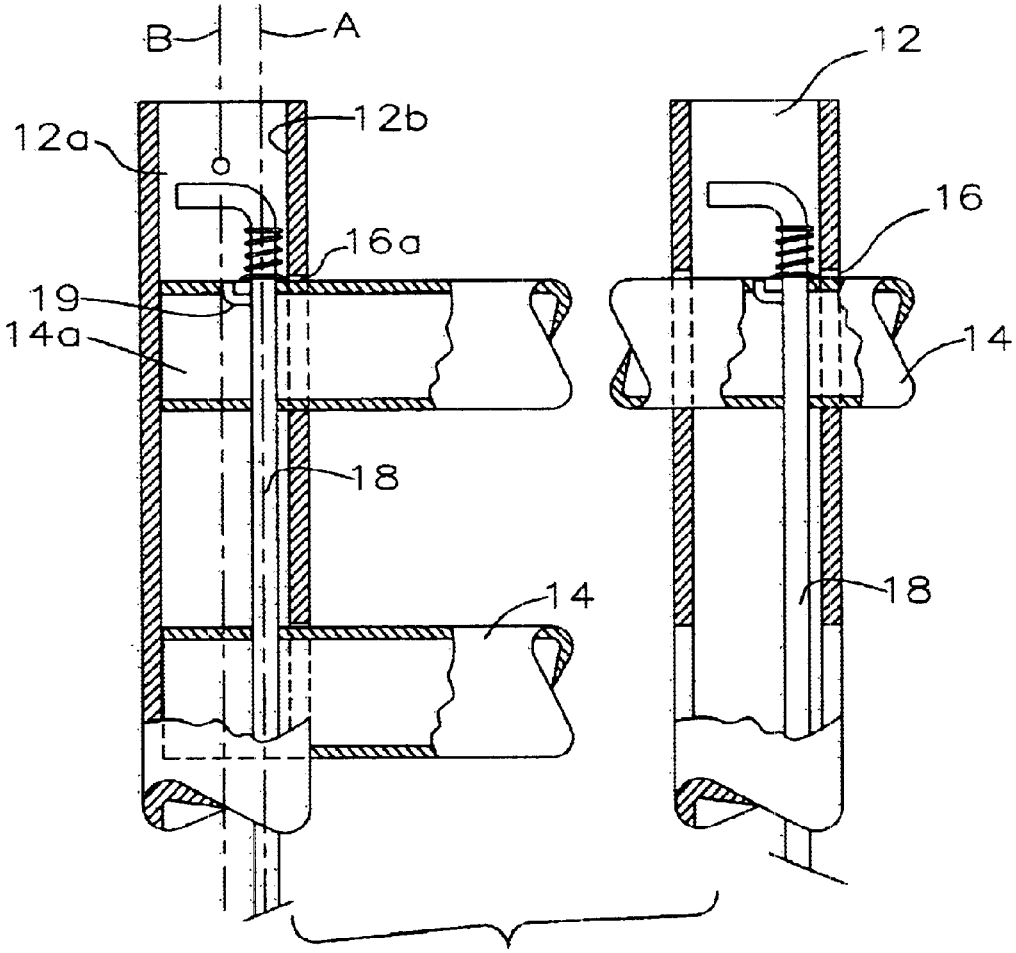
FIG. 2 is, in enlarged sectional view, a portion of FIG. 1.

Thus, in one embodiment of the present invention a fence panel 10 such as seen in FIG. 1 may be constructed of fence posts 12 and cross-members 14. Cross-members 14 may be one continuous length of piping or tubing (hereinafter collectively referred to as piping) for example in twenty-seven foot lengths, or may be constructed modularly as nine foot long panels extending between pairs of intermediate posts 12. Posts 12, as better seen in FIG. 2, are lengths of piping, for example six feet long, having, along their length, a longitudinally spaced-apart array of oppositely disposed pairs of apertures 16, formed as for example by drilling, and sized to mate, for example, snugly with corresponding ends of cross-members 14. Cross-members 14 are, thus, of smaller outside diameter in lateral cross section than are posts 12.

The array of apertures 16 in each post 12 allow for the journaling through each oppositely disposed pair of apertures 16 of a single cross-member 14 so that individual posts 12 may be selectively spaced along the cross-members between end or comer posts 12*a*.

Figures 4, 4A:
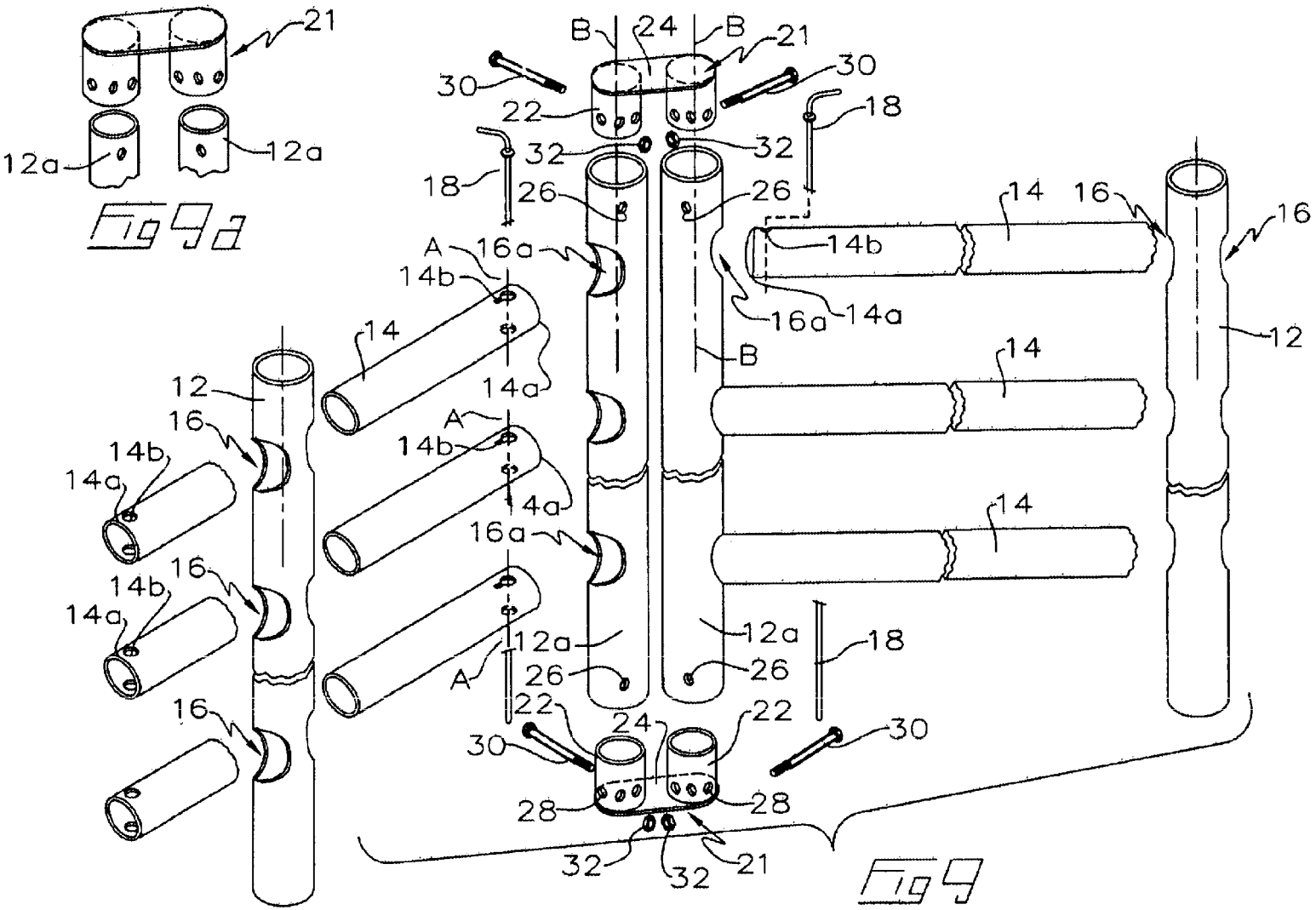
FIG. 4 is a sectional view taken on line 4—4 of FIG. 3.
Figure 10:
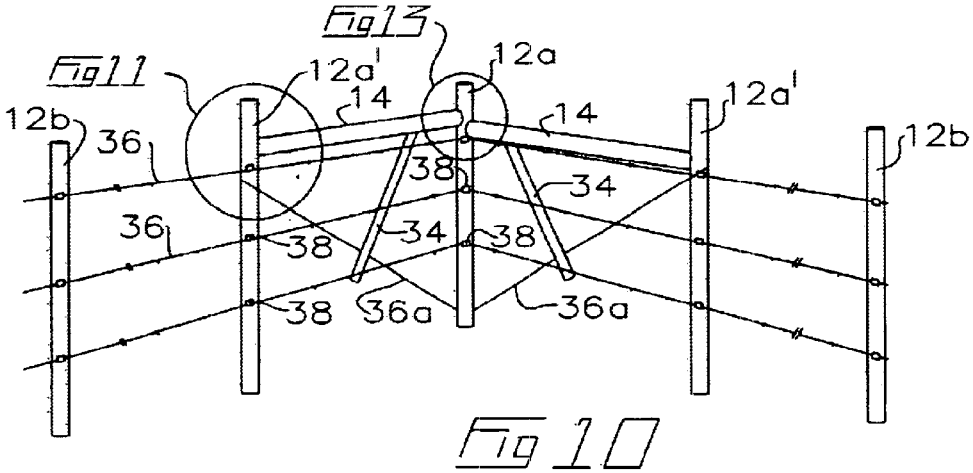
FIG. 10 is a perspective view of a further embodiment of the present invention.
Figure 12:
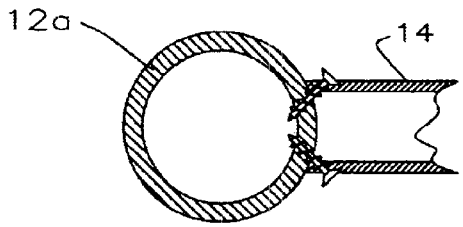
FIG. 12 is a sectional view taken on line 12—12 of FIG. 11.

End or comer posts 12*a* also have, spaced along their lengths, a longitudinally spaced-apart array of apertures, indicated in FIGS. 2 and 9 as apertures 16*a*. The ends 14*a* of cross-members 14 insert into apertures 16*a*, for example they snugly insert as better seen in cross-section in FIGS. 3 and 4. Thus as seen in FIG. 3, each end 14*a* of cross-members 14 are themselves apertured with an oppositely disposed pair of holes or apertures 14*b* defining therebetween a common axis A which, when end 14*a* is inserted into aperture 16*a*, may be positioned adjacent an inside wall 12*b* of corner posts 12*a* in general parallel alignment with an axis of symmetry B of the corresponding end or comer post 12*a*. Thus, for every aperture 16*a* in a post 12*a*, an end 14*a* of a cross-member 14 may be inserted into the aperture so that each pair of holes or apertures 14*b*, and in particular axis A of each pair of holes or apertures 14*b*, may be positioned in proximity to inside wall 12*b* of posts 12, so that a single pin or rod 18 may be inserted into an end of post 12*a* in a direction along axis A so as to mate in, by being journalled through, all of the holes or apertures 14*b* in all of the ends 14*a*. Thus, insertion, for example downwardly, of a single rod 18, may anchor a single cross-member 14 or a plurality of cross-members 14. Rod 18 may have a stop at one end, for example the right-angle hook illustrated, to prevent the rod sliding out of holes or apertures 14*b*.

Figure 6:
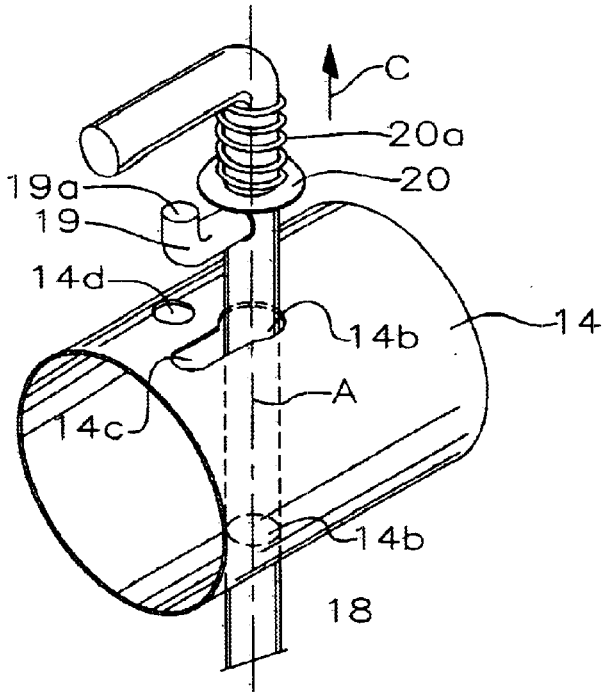
FIG. 6 is, in perspective view, the locking member of the present invention.

In a further preferred embodiment, rod 18 may have a locking pin 19 projecting outwardly generally at right-angles from rod 18, and terminating in an upstanding end 19*a*. An aperture 14*b*', which would be an uppermost aperture in an upper cross-member 14, is slightly elongated, for example to form keyway 14*c* as seen in FIG. 6, to permit pin 19 to be inserted downwardly through keyway 14*c* into cross-member 14. Upon rotation of pin 19, upstanding end 19*a* is brought into alignment with locking aperture 14*d*. A washer 20 and spring 20*a* are mounted on rod 18 between pin 19 and the end stop or hook. With upstanding end 19*a* inserted through aperture 14*d*, spring 20*a* urges rod 18 in direction C ensuring positive retention of rod 18 within the ends 14*a* of cross members 14.

The plurality of cross-members 14 may all lie in a common plane extending between a spaced-apart parallel pair of posts, either intermediate post 12 or end or corner post 12*a*. The plurality of cross-members 14 may extend away from the corner post in radially spaced-apart relation relative to axis B. Thus, for example, a first set of cross-members 14 lying in a first plane may extend from a corresponding first set of apertures 16*a* away from a corner post towards a first spaced-apart post, and a second set of cross-members lying in a second plane, where the second plane is radially spaced-apart from the first plane about a long axis of the comer post, extend away from the corner post towards a second spaced-apart post. The first and second planes intersect along the long axis of the corner post. Thus, the angle subtended between the first set of cross-members lying in the first plane and the second set of cross-members lying in the second plane may define a ninety degree comer, or, where the fence panels are to continue linearly, may be one hundred eighty degrees, or may be varied to suit any desired angular orientation between the two adjacent fence panels.

Figure 7:
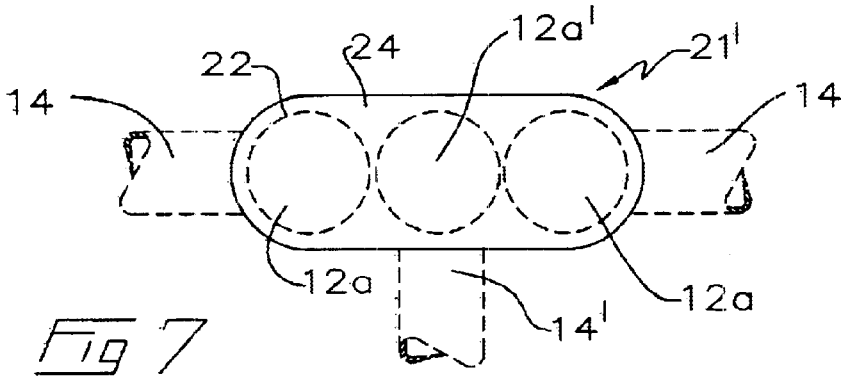
FIG. 7 is a plan view of an alternative form of post coupler for use where cross fencing id desired.
Figure 8:
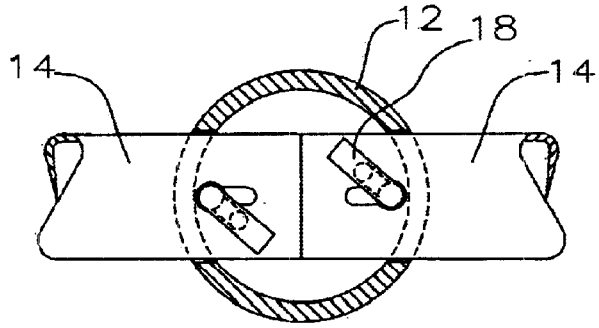
FIG. 8 is a sectional view of abutting cross-members of adjacent fence sections secured within a common post.

Alternatively, in the embodiment of FIGS. 7, 9 and 9*a*, rather than perforating a single end post 12*a* with more than one set of apertures 16*a*, where the number of sets of apertures 16*a* correspond to the number of planar sets of cross-members 14 desired to extend from the single post, a pair of end posts 12*a* may be coupled together, for example as portable rodeo panels, by a post coupler, advantageously top and bottom post couplers 21.

In one embodiment not intended to be limiting, each post coupler 21 includes a pair of collars 22 mounted to a single common member, for example plate 24. Plate 24 may have an aperture or hole in it (not shown), for example centered along the plate to be used for staking down the posts. In use, a pair of opposed facing post couplers 20 oriented such as seen in FIG. 9, are inserted into (or over as seen in FIG. 9*a*) the open ends of a pair of adjacent and parallel posts 12*a*. Each of the posts 12*a* is rotated about its own axis of symmetry B until the desired orientation of aperture or apertures 16*a* on one of the posts relative to the aperture or apertures 16*a* on the other post is attained. Pair of bolt holes 26 in each end of each post 12*a* are aligned with corresponding holes 28. Holes 28 are radially spaced-apart around collars 22. Thus, depending on the number of holes 28 radially spaced-apart around collars 22, the available number of angular orientations of posts 12*a* about their respective axes B is limited to the numbers of holes 28, because bolt holes 26 are aligned at the desired angular orientation with a corresponding pair of holes 28 in collars 22. In one example, collars 22 may each have eight holes 28 evenly radially spaced around each of the collars allowing for orientation of posts 12*a* in forty-five degree increments relative to their corresponding axes B. Once each of the posts 12*a* are aligned as desired, bolts 30 are inserted through bolt holes 26 and the correspondingly aligned holes 28 and secured therethrough for example by means of nuts 32.

As may be viewed in FIG. 7, an alternative form of post coupler 21 containing three collars 22 allows for the secure positioning of the end post 12*a*' of an intersecting fence panel including cross member 14; between a pair of posts 12*a* supporting cross members 14 where cross-fencing is desired, the posts shown in end view encircled by collars shown in dotted outline.

Figure 13:
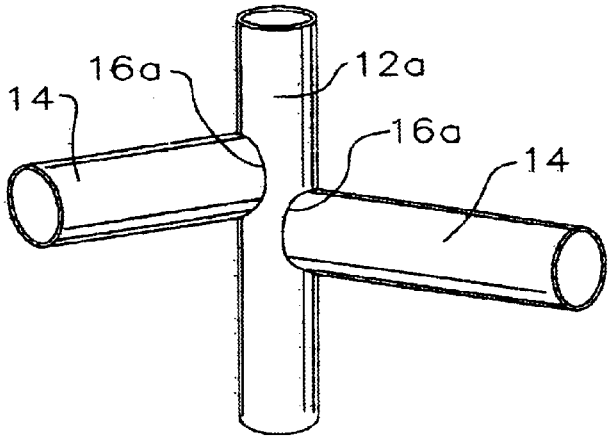
FIG. 13 is an enlarged view of a portion of FIG. 10 showing cross members stagger mounted to a corner post.
Figure 13A:
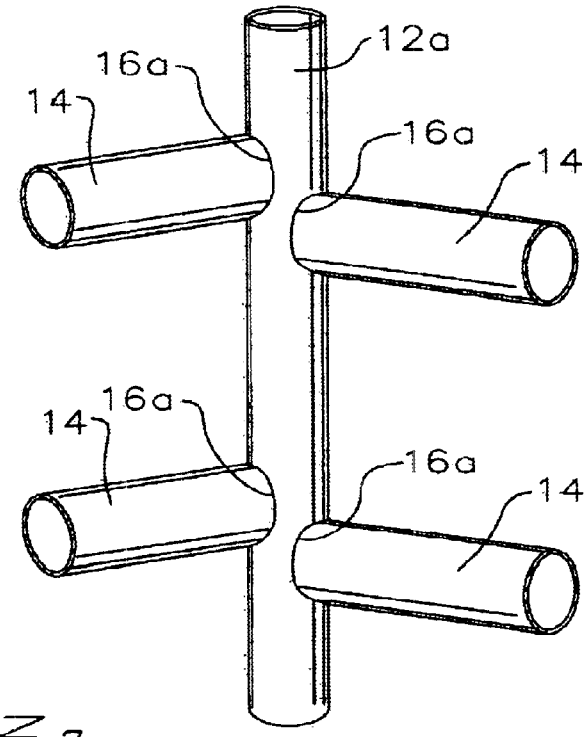
FIG. 13*a* is an enlarged view of a portion of a corner post showing cross members mounted thereto in staggered arrays.

In the embodiment of FIGS. 10–13, the fencing system of the present invention is used to provide a braced comer in a tensioned wire or barbed wire fence. A single comer fence post 12*a* has, at an upper end thereof, a pair cross-members 14 extending from post 12*a* to a corresponding pair of end posts 12*a*'. The corner post has a pair of vertically offset apertures 16*a*. Offset apertures 16*a* may be a pair of offset staggered arrays of apertures if more than only one pair of cross members 14 are to be mounted to the corner post, as ween in FIG. 13*a*. Cross-members 14 are offset and mounted to the corner post in the manner of FIG. 3. The pair of end posts each have a single aperture at an upper end thereof. Cross-members 14 are mounted in the end post apertures so as to extend the cross-members generally horizontally between the corner post and the pair of end posts. A pair of bracing members 34, which may also be of piping, may be mounted for example to cross-members 14, again, by mounting the upper ends of the bracing members into apertures formed as by drilling into cross-members 14. Alternatively, as viewed in FIGS. 11 and 12 the ends of cross members 14 may be cupped in a radius matching that of corner fence post 12*a* and secured with self tapping screws to post 12*a*.

Figure 11:
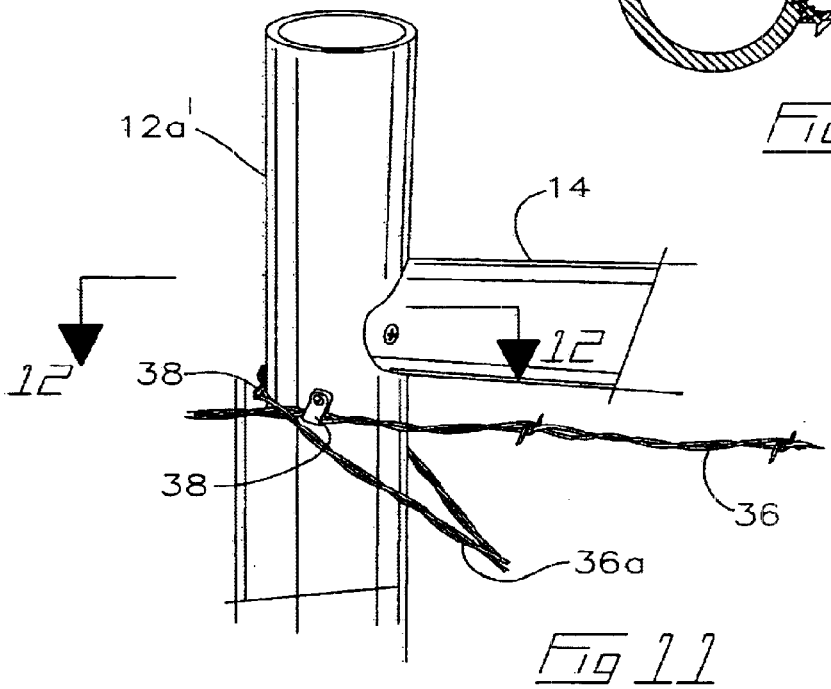
FIG. 11 is an enlarged detail of a portion of FIG. 10.

As better seen in FIG. 11, the tensioned wire or barbed wire 36 may be mounted to the posts using conventional clips 38 fastened to the side walls of the posts. In this embodiment, intermediate posts 12*b*, which are also made from lengths of piping, for example six feet long, are not apertured to accept cross-members 14. Where further lengths of barbed wire 36*a* are used to cross brace between the end posts and the corner post, where the ends of the cross bracing barbed wire wrap around the posts, the barbed wire may also be secured to the posts by clips 38.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A fencing system comprising:

elongate posts and cross-members, wherein said posts are hollow tubular posts having cylindrical cavities having an inside diameter along their length and apertures formed in side walls thereof for accepting in mating engagement therein said cross-members when said cross-members extend between adjacent posts in a parallel array of said posts, said cross-members each having a hole in at least one end thereof, said hole extending laterally through said end of said cross-members and spaced from said end of said cross members by substantially said inside diameter, a rod insertable into said cylindrical cavity of at least one of said posts for mating into each said hole of each of said cross-members when said cross-members are mated and fully inserted into said apertures, each said hole of each of said cross-members sized to accept said rod in journalled relation therethrough, wherein a single said rod releasably locks a plurality of said cross-members mounted to said at least one of said posts by sliding along and closely adjacent an inside wall of said posts and through said holes in said cross members.

2. The fencing system of claim 1 wherein said posts include first posts having first and second spaced apart arrays of said apertures, said apertures spaced apart along a length of said first posts, said first and second arrays radially spaced from one another relative to respective longitudinal axes of said first posts.

3. The fencing system of claim 2 wherein said first and second arrays are staggered relative to each other so that said apertures of said first array are offset along the length of said first posts relative to said apertures of said second array.

4. The fencing system of claim 3 wherein said longitudinal axes are axes of symmetry of said first posts.

5. The fencing system of claim 4 wherein said first posts are corner posts.

6. The fencing system of claim 4 wherein said first posts are end posts.

7. The fencing system of claim 2 wherein said first posts are intermediate posts and wherein said first and second arrays of said apertures are aligned so that a single parallel co-planar set of said cross-members may be jouralled through both said first and second arrays of said apertures in each of said intermediate posts.

8. The fencing system of claim 1 wherein said posts are at least one pair of said posts coupled in adjacent parallel relation to one another by at least one coupler, wherein said coupler comprises a pair of post engaging members mounted to a common rigid member, said post-engaging members adapted to mate with adjacent first ends of said pair of said posts.

9. The fencing system of claim 8 wherein said post-engaging members are collars.

10. The fencing system of claim 9 wherein said collars are sized to snugly journal into said first ends of said pair of said posts.

11. The fencing system of claim 9 wherein said collars are sized to snugly journal over said first ends of said pair of said posts.

12. The fencing system of claim 9 wherein each first end of said first ends of said pair of said posts has a hole in a side wall thereof, and wherein said collars each have a radially spaced-apart array of holes radially spaced around axes of symmetry of said collars, so that, when said collars are mounted to said first ends of said pair of said posts so that said axes of symmetry of said collars are co-axial with axes of symmetry of said posts in said pair of said posts, said hole in said each first end may be selectively aligned with a hole in each said radially spaced-apart array of holes and a locking member fastened therethrough to releasably lock said pair of said posts in desired positions relative to one another so as to releasably lock a first array of apertures in a first adjacent post of said pair of said posts in desired angular relation relative to a second array of apertures on a second adjacent post of said pair of said posts.

13. The fencing system of claim 8 wherein said at least one coupler is a pair of couplers mountable to opposite ends of said pair of said posts so as to maintain said pair of said posts in said parallel adjacent relation.

14. The fencing system of claim 13 wherein said post-engaging members are collars.

15. The fencing system of claim 14 wherein said collars are sized to snugly journal into said first ends of said pair of said posts.

16. The fencing system of claim 14 wherein said collars are sized to snugly journal over said first ends of said pair of said posts.

17. The fencing system of claim 14 wherein each first end of said first ends of said pair of said posts has a hole in a side wall thereof, and wherein said collars each have a radially spaced-apart array of holes radially spaced around axes of symmetry of said collars, so that, when said collars are mounted to said first ends of said pair of said posts so that said axes of symmetry of said collars are co-axial with axes of symmetry of said posts in said pair of said posts, said hole in said each first end may be selectively aligned with a hole in each said radially spaced-apart array of holes and a locking member fastened therethrough to releasably lock said pair of said posts in desired positions relative to one another so as to releasably lock a first array of apertures in a first post of said pair of said posts in desired angular relation relative to a second array of apertures on a second post of said pair of said posts.

18. The fencing system of claim 1 wherein said posts are of fibre-glass piping.

19. The fencing system of claim 18 wherein said apertures are holes drilled into side walls of said piping.

20. The fencing system of claim 8 wherein said at least one coupler includes a pair of couplers mountable to opposite ends of said pair of posts so as to maintain said pair of said posts in said parallel adjacent relation, a third coupler mounted between said pair of couplers and mountable to a third post for supporting cross fencing.

* * * * *